United States Patent [19]

Engel

[11] 4,096,896

[45] Jun. 27, 1978

[54] COMPOSITE TOOL STRUCTURE

[75] Inventor: Paul Richard Engel, Rochester, N.Y.

[73] Assignee: Upson Tools, Inc., Rochester, N.Y.

[21] Appl. No.: 792,250

[22] Filed: Apr. 29, 1977

[51] Int. Cl.[2] ..... B25B 15/00

[52] U.S. Cl. ..... 145/50 B; 145/50 C

[58] Field of Search ..... 145/50 B, 50 C

[56] References Cited

U.S. PATENT DOCUMENTS

| | | | |
|---|---|---|---|
| 814,020 | 3/1906 | Clifford | 145/50 C |
| 1,449,136 | 3/1923 | Yates | 145/61 F |
| 2,378,775 | 6/1945 | Johnson | 145/50 C |
| 2,658,766 | 11/1953 | Rock | 145/50 C |
| 2,667,194 | 1/1954 | Fischer et al. | 145/50 B |

FOREIGN PATENT DOCUMENTS

| | | | |
|---|---|---|---|
| 596,539 | 8/1925 | France | 145/50 C |
| 1,181,648 | 11/1964 | Germany | 145/50 B |

*Primary Examiner*—James L. Jones, Jr.
*Assistant Examiner*—J. T. Zatarga
*Attorney, Agent, or Firm*—Lloyd F. Seebach

[57] ABSTRACT

The invention relates to a composite tool structure in which an interconnection is effected between a tool receiving device and a tool member by providing mating parts with conforming polygonal shapes and a deformable elastomeric ring to obtain an optimum torque transfer between the tool receiving device and the tool member.

9 Claims, 8 Drawing Figures

COMPOSITE TOOL STRUCTURE

FIELD OF THE INVENTION

The invention relates to an improved composite tool receiving device or structure for providing an optimum torque transfer between a tool receiving device, such as a manually or power-driven rotatable device, and an interchangeable tool member having at least one tool configuration associated therewith, such as a screw driver, a nut driver, a chisel, a drill, etc.

DESCRIPTION OF THE PRIOR ART

The prior art discloses various ways in which a plurality of tools can be interchanged with a single handle or similar device. In each instance, however, the interconnection between the tool and the handle is such that with repeated usage, the torque transfer becomes less and less because of wear and, at some point, slippage occurs which renders the interconnection useless. Further, in order to facilitate such interchangeability, the mating parts are made so as to be joined together, or inserted one within the other, with very little effort, thereby allowing some torque backlash. When a resilient connection is utilized between the tool member and the handle, the resiliency factor may well determine the maximum torque that can be applied before slippage occurs. In this case, such maximum torque may not be sufficient to completely accomplish the full tool operation, for example, a firm and positive setting of a screw or nut.

SUMMARY OF THE INVENTION

The object of the present invention is to provide an interconnection between a rotatable device and a tool member whereby an optimum torque transfer is obtained.

Another object of the invention is to provide an interconnection between a manual or power-driven device and any one of a number of tool members, whereby an optimum torque transfer is obtained.

Still another object of the invention is to provide deformable means on each of a number of similar tool members, whereby when any one of the tool members is inserted in a rotatable device, that is manually or power-driven, an optimum torque transfer is obtained between the device and the tool member.

Yet another object of the invention is to provide each of a number of tool members with an elastomeric ring, or a split, resilient metallic ring, whereby when any one of the tool members is inserted in a rotatable device, that can be manually or power-driven, the ring insures an optimum torque transfer between the device and the tool member.

Other objects and advantages of the invention will be apparent to those skilled in the art by the description which follows and which is made in connection with the accompanying drawings.

Briefly, the objects of the invention are attained by utilizing a split, resilient metallic ring, or an elastomeric ring, on each of a number of similar tool members so as to make such members interchangeable with respect to the same receiving device and to provide an optimum torque transfer between any one of the tool members and the device. The tool member can be provided with a tool configuration at either one or both of its free ends. Such a tool configuration can take most any form, for example, the ends can be of a size and shape for driving and turning slotted and recess-slotted screws of various sizes, for turning and driving nuts of different sizes or shapes, formed as a chisel for working and shaping wood, plastic, or the like, formed as a router for working or shaping wood, plastic, or the like, or even as a drill for wood, plastic, metal, or the like. On a smaller or larger scale, the invention can be applied to many devices in which an optimum torque transfer is required between two elements, one of which is rotated either manually or by a suitable power-driven mechanism.

As shown and described hereinafter, the tool member can be provided with a tool configuration at only one end or at each end. With supplementation of an intermediate holding means, as will be later described, two tool members, each with a tool configuration at each free end, will permit any one of four tool possibilities to be selected for use at a particular time. The interchange can be easily accomplished with no loss of time for locating another tool for another use with a different size requirement. The change can be quickly made by merely interchanging or reversing a tool member and/or by reversing the holding means relative to the handle or device.

DESCRIPTION OF THE DRAWINGS

Reference is now made to the accompanying drawings wherein like reference numerals and letters designate like parts and wherein.

DESCRIPTION OF A PREFERRED EMBODIMENT

Figure 1:
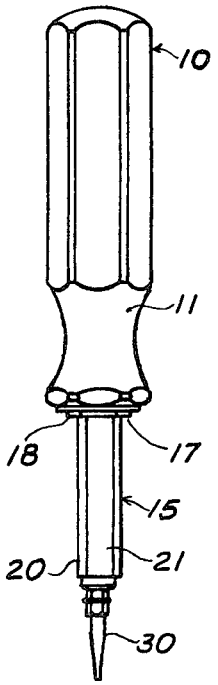
FIG. 1 is an elevational view of a screw driver handle which can serve as one form of tool receiving device in which the invention is embodied.
Figure 2:
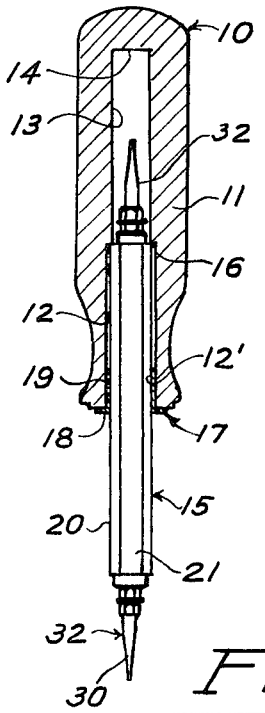
FIG. 2 is an elevational view similar to FIG. 1, with the handle shown in section, and showing the manner in which two double-ended tool members are retained by an intermediate holding means and connected to the handle for rotation therewith.

With reference to the drawings and particularly with respect to FIGS. 1 and 2, a tool receiving device 10 is shown in one form as a screw driver handle 11. It will be appreciated by those skilled in the art that the handle 11 can take other forms not only in devices that are manually rotated but that are power-driven as well. For example, the handle 11 can be considered equivalent to a chuck associated with a power-driven drill press of the floor or bench type, a power-driven screw or nut driver, a router, a dentist type drill, and the like. By these examples, it is meant to be made clear that the invention is applicable not only to many types of tool receiving devices but also to various sizes of such devices. However, for the purpose of this disclosure, the tool receiving device, as used in connection with the invention, will be described as a handle but is not considered as being limited to such.

As with many types of screw drivers, the handle 11 can be fluted to provide a more positive manual exertion of force (torque) on the handle. The handle 11 is provided with an axial, open-end opening 12 that is preferably polygonal in cross-section. In the present instance, it has been found that a hexagonal cross-section is most satisfactory for reasons which will become apparent as the description progresses. A second opening 13 that is axially aligned and coextensive with opening 12 has a blind end 14 and can be of circular cross-section. As will be described in more detail hereinafter, the axial length of opening 12 is such that a sufficient length of an intermediate holding means 15 can be inserted therein with one end abutting a shoulder 16 formed by the juncture of the openings 12 and 13 to provide a good bearing length, the cross-section of opening 13 being at least equal to or smaller than the minimum cross-sectional dimension of opening 12.

The handle 11 can be made of wood, plastic, or a similar material. In order to provide a good fit between the holding means 15 and opening 12 which, at the same time minimizes wear possibility, a metallic insert 17 can be positioned in the open end of opening 12. Such an insert 17 has a circular flange 18 and an axial extension 19 of polygonal cross-section that conforms to that of opening 12 and can, preferably, be a press fit therein. The extension 19 has an axial opening or bore 12' that has a polygonal cross-section similar to that opening 12. Hence, when the insert 17 is used, the opening 12' is considered to be the equivalent of the opening 12.

Figure 4:
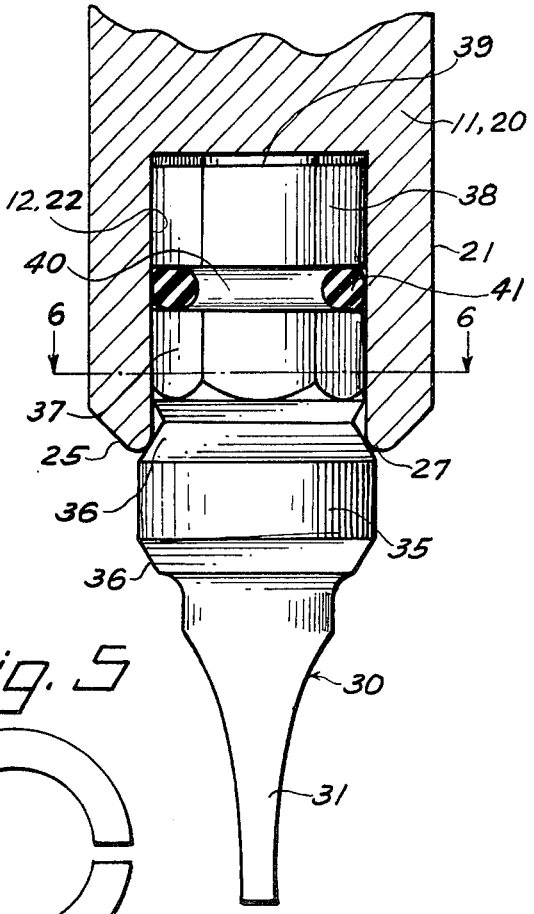
FIG. 4 is a vertical sectional view showing a tool member having a single tool configuration and inserted in an open-end opening of a handle or tool receiving device.
Figure 3:
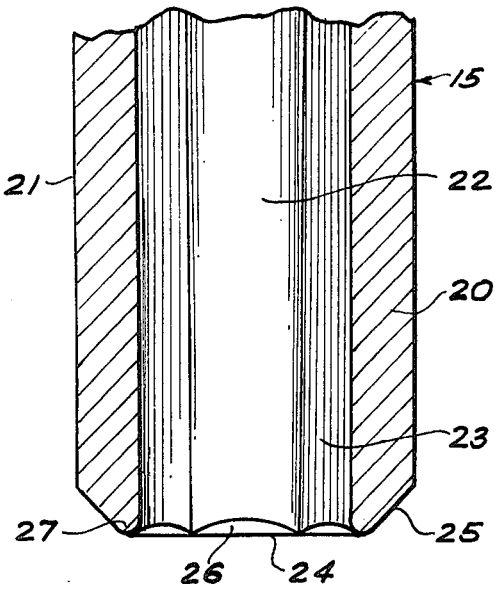
FIG. 3 is a detailed sectional view of an end of the intermediate holding means shown in FIGS. 1 and 2.

The intermediate holding means 15 is, preferably, a tubular member 20 having an external cross-section 21 that conforms to that of the opening 12 or of the opening 12'. The internal opening or bore 22 has a cross-section 23 that is also of polygonal shape throughout the full length of the member 20 or for only a portion of the length, see FIGS. 3, 4 and 7. The ends 24 of the member 20 are beveled as at 25 in the drawings, and the opening 22 is also beveled as at 26 to provide a generally rounded nose 27, the purpose of which will be described hereinafter. With a single tool member 30, as shown in FIG. 4, the handle 11 can be provided with only the opening 12 of polygonal shape, the insert 17 being omitted. In this case, the bevels 25 and 26 and the nose 27 are formed on the end of the handle 11 with respect to the opening 12 and can be also formed with respect to the opening 12', if the insert 17 is used.

The tool member 30 in accordance with the invention, can take several forms. As shown in FIG. 4, the tool member 30 can have a single tool configuration 31 at one end or can be of a dual type 32, see FIGS. 2, 7 and 8, with one configuration 33 at one free end and another tool configuration 34 of different form and/or size at the other free end. With respect to FIG. 4, the tool member 30 has a first portion 35 that is circular in cross-section and has a beveled facing surface 36 on each side thereof. A second portion 37 extends axially from one facing surface 36 and has an external polygonal cross-section 38 that conforms generally to the polygonal cross-section of the opening 12, the opening 12' or the bore 22. As seen in FIG. 4, the tool configuration 31 extends axially from the other facing surface 36. Intermediate the free end 39 of the second portion 37 and the facing surface 36, a recess 40 is provided in which a deformable means 41 is retained.

Figure 5:
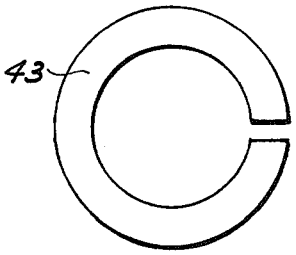
FIG. 5 is a detail elevational view of one type of deformable means, namely, a split, resilient metallic ring.
Figure 6:
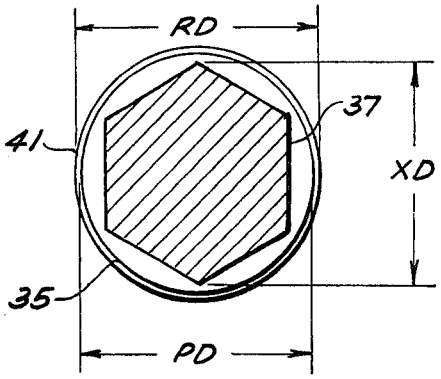
FIG. 6 is a sectional view taken on line 6—6 of FIG. 4 and showing the dimensional relationship of different cross-sections of the tool member.

The deformable means 41 can comprise an elastomeric ring 42 or a split, resilient metallic ring 43, the latter being shown in FIG. 5. With reference to FIG. 6, the dimensional relationship is shown for the various cross-sections of the tool member, whereby an interconnection is provided that will permit an optimum torque transfer between the device 10 and the tool member 30 or between the device 10, the intermediate holding means 15 and the tool member 30. Before proceeding further with the description, it should be understood that the intermediate holding means 15 is not necessarily an element of the invention in one of its embodiments but does enhance the applicability of the invention. The second portion 37 of the tool member 30, see FIG. 4, can be inserted directly into opening 12 or into opening 12', if insert 17 is used, provided the cross-section of the mating parts is compatible. This means that opening 13 is needed only when a dual tool member 32 is used in conjunction with holding means 15 or without such means. However, whether a single or a dual tool member is used, the interconnection is accomplished in substantially the same way. When the second portion 37 is inserted in the opening 12, in the opening 12' or in the opening 22 of the holding means 15 and moved axially inward, the ring 41 is urged into the recess 40 by the nose 27 and the bevel 26 formed by the polygonal surfaces of the openings 12, 12' or 22. The tool member is moved inwardly until the nose 27 abuts the one facing surface 36, see FIG. 4. At this point, an optimum torque transfer can be effected between the parts with no slippage or wear.

As pointed out hereinabove, it has been noted that a hexagonal cross-section for the various mating parts is most desirable in that bar stock and tubular stock of such cross-section are available on the market in usable sizes. With reference to FIG. 6, it will be noted that the outer diameter RD of the ring 41 is slightly greater than the diameter PD of the first portion 35. Also, the diameter PD of the first portion 35 is somewhat larger than the across-corners dimension XD of the hexagonal second portion 37. Such a dimensional relationship provides for the necessary fitting of the elements to effect the desired torque transfer.

Figure 7:
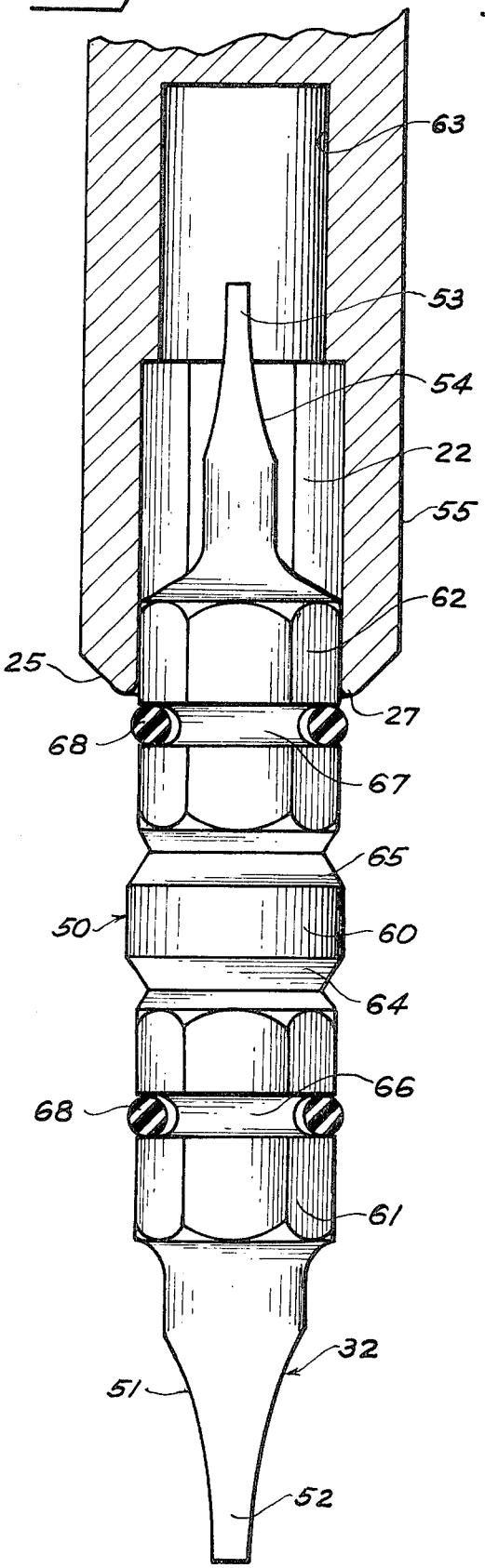
FIG. 7 is an enlarged vertical sectional view of one form of intermediate holding means in which a single tool member can be contained and in which the tool member has not yet been completely seated.
Figure 8:
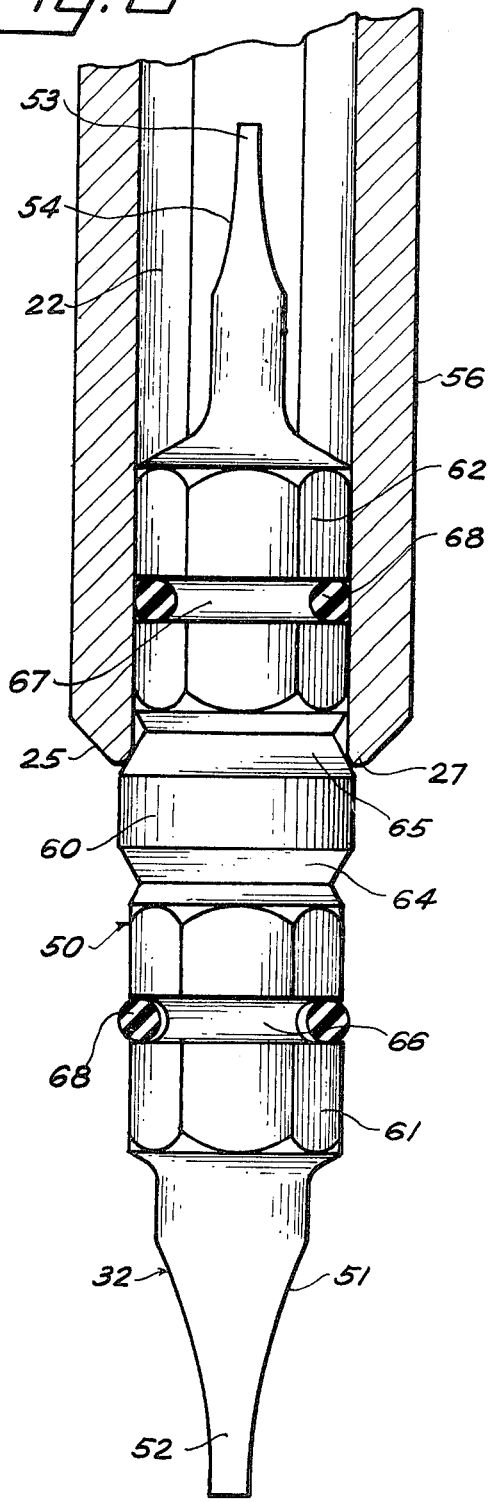
FIG. 8 is an enlarged vertical sectional view of another form of intermediate holding means in which two tool members, as shown in FIG. 2, can be contained and in which the tool member has been completely seated.

With reference to FIGS. 7 and 8, a tool member 50 is disclosed in which a first tool configuration 51 is provided at one free end 52 and a second tool configuration 53 is provided at the other free end 54. As mentioned above, the tool configuration can be any one of many types. The type, of course, will determine the particular or special material that is required to fabricate the tool member. When a dual type of tool member is used, the configuration on each end are usually of the same type but of a different size. In this way, two possibilities exist if the tool member is used with only the handle 11 or with a holding means 15 that is non-reversible. When a reversible holding means is used, a tool member can be carried at each end of the holding means, Consequently, four different tool sizes can be made available with reversal of the holding means 56 and reversal of either tool member 50 in each respective end of the holding means.

The tool member 50, shown in FIGS. 7 and 8, has a first, central portion 60 that is circular in cross-section and has a diameter slightly larger than the across-corners dimension of the second portions 61 and 62. The portions 61 and 62 are, preferably, hexagonal in shape (cross-section) and conform generally in size and shape to the cross-section of the opening 22 in the holding means 55 and 56. It will be noted that opening 22 extends only part way through or into holding means 55 and has an axially, coextensive bore 63 for receiving the tool configuration not being used, whereas the polygonal opening or bore 22 extends the full length of holding means 56 for containing two dual tool members 50, as shown in FIG. 2. The first portion 60 has beveled facing surfaces 64 and 65 from which each respective second portion 61 and 62 extends. The third portions or free ends 52 and 54 comprise the tool configurations 51 and 53, as seen in FIGS. 7 and 8. Intermediate the ends 52 and 54 and the respective facing surfaces 64 and 65, recesses 66 and 67 are provided in each respective second portion 61 and 62. Each of the recesses 66 and 67 retain a deformable member 68 which can be an elastomeric ring, preferably, or a split, resilient metallic ring.

When a tool member 50 is inserted in handle 11 or holding means 55, the ring 68 is compressed and moved deeper into recess 66 or 67 by bevel 26 and nose 27, as described above, until it is fully contained in the recess and, under this condition, the ring 68 also frictionally engages the polygonal sides or surfaces of the openings 12, 12' or 22. With such engagement and the conforming polygonal shape of the second portion 38, 62 or 65, a very positive interconnection is obtained so an optimum torque transfer can be accomplished between the handle 11 and/or the intermediate holding means as designated by 15, 55 and 56 and either a single or a dual type of tool member 30 or 50.

This invention has been described in detail with particular reference to preferred embodiments thereof, but it will be understood that variations and modifications can be effected within the spirit and scope of the invention.

I claim:

1. A tool receiving device having at least one open-end, axially extending opening of polygonal cross-section with a plurality of longitudinally straight surfaces, comprising in combination:

a tool member comprising at least three axially coextensive portions including a first portion having a cross-section conforming generally to that of the polygonal opening and insertable therein and a generally intermediate annular recess, a second portion having a cross-section different from and dimensionally larger than that of the first portion, a facing surface contiguous to the first portion for limiting the extent of insertion of the first portion into the opening, and a second facing surface spaced from the first facing surface, and a third portion extending from the second facing surface and having a tool configuration at the free end thereof; and an elastomeric ring arranged in the recess and having an outer diameter dimensionally greater than that of the polygonal cross-section of the first portion and of the second portion for frictionally engaging the respective straight surfaces of the opening when the first portion is inserted therein to retain the tool member in the opening and for providing an optimum torque transfer between the device and the tool member.

2. A tool receiving device in accordance with claim 1 wherein the cross-section of the opening and of the first portion is hexagonal and that of the second portion is circular.

3. A tool receiving device having at least one open-end, axially extending opening of polygonal cross-section with a plurality of longitudinally straight surfaces, comprising in combination:

an intermediate, tubular holding means provided at least at one end thereof with a longitudinally extending portion having an external cross-section conforming generally to that of the opening in the device for insertion therein and a longitudinal bore of polygonal cross-section, the length of the holding means being such that the one end abuts the inner end of the opening in the device and the other end extends from the device;

a tool member insertable into the other end of the holding means comprising at least three axially coextensive portions including a first portion having a cross-section conforming generally to that of the polygonal bore and insertable therein and a generally intermediate annular recess, a second portion having a cross-section different from and dimensionally larger than that of the first portion, a first facing surface contiguous to the first portion for limiting the extent of insertion of the first portion into the bore, a second facing surface spaced from the first facing surface, and a third portion extending from the second facing surface and having a tool configuration at the free end thereof; and an elastomeric ring arranged in the recess and having an outer diameter dimensionally greater than that of the polygomal cross-section of the first portion and of the second portion for frictionally engaging the respective straight surfaces of the bore when the holding means is inserted in the opening and the first portion is inserted in the other end thereof to retain the tool member in the bore with the tool configuration extending from the device and for providing an optimum torque transfer between the device, the holding means, and the tool member.

4. A tool receiving device in accordance with claim 3 wherein the cross-section of the opening, of the longitudinal extending portion, of the bore and of the first portion is hexagonal and that of the second portion is circular.

5. A tool receiving device having a first open-end, axially extending opening of polygonal cross-section with a plurality of longitudinally straight surfaces and a second blind-end, opening axially coextensive with and dimensionally smaller than the first opening, comprising in combination:

a tool member comprising a series of axially coextensive portions including a first central portion having a cross-section dimensionally larger than the first opening and a facing surface contiguous each end thereof, a second portion extending from each respective facing surface and having a cross-section conforming generally to that of the first opening and a generally intermediate annular recess, and a third portion extending from each respective second portion and provided with a tool configuration at each respective free end thereof;

each respective facing surface limiting the extent of insertion of the second portion into the first opening and of the adjoining third portion into the second opening, whereby a selected one of the tool configurations extends from the device; and an elastomeric ring arranged in each recess and having an outer diameter dimensionally greater than that of the polygonal cross-section of the second portion and of the first portion for frictionally engaging the respective straight surfaces of the first opening to retain the inserted second portion in the first opening with the third portion within the second opening and for providing an optimum torque transfer between the device and the second portion of the tool member inserted into the first opening of the device.

6. A tool receiving device in accordance with claim 5 wherein the cross-section of the first opening and of the second portion is hexagonal and that of the second opening is circular and of a diameter dimensionally greater than the overall cross-section of the third portion and of the tool configuration.

7. A tool receiving device having a first open-end, axially extending opening of polygonal cross-section and a second blind-end, opening axially coextensive with and dimensionally smaller than the first opening, comprising in combination:

an intermediate, tubular holding means provided with an external, longitudinally extending cross-section of polygonal shape conforming generally to that of the first opening for insertion thereinto and an axial bore of polygonal cross-section with a plurality of longitudinally straight surfaces, the length of the holding means being such that when one end thereof is inserted in the first opening and abuts the inner end of the first opening, the other end extends from the device;

a tool member insertable into either end of the holding means comprising a series of axially coextensive portions including a first central portion having a cross-section dimensionally larger than the polygonal bore and a facing surface contiguous each end thereof, a second portion extending from each respective facing surface and having a cross-section conforming generally to that of the polygonal bore and a generally intermediate annular recess, and a third portion extending from each second portion and provided with a tool configuration at each respective free end thereof;

each respective facing surface limiting the extent of insertion of one of the second portions and of its adjoining third portion into the one end of the holding means when the latter is inserted in the first opening, whereby the selected tool configuration extends from the one end of the holding means and the other tool configuration is contained within the polygonal bore of the holding means; and an elastomeric ring arranged in each recess of each second portion and having an outer diameter dimensionally greater than that of the polygonal cross-section of the second portion and of the first portion for frictionally engaging the straight surfaces of the polygonal bore of the holding means to retain the inserted second and third portions of the tool member therein and for providing an optimum torque transfer between the device, the holding means, and the second portion having the adjoining third portion with the selected tool configuration extending from the device.

8. A tool receiving device in accordance with claim 7 wherein the cross-section of the first opening, of the polygonal shape, and of each respective second portion is hexagonal and that of the first portion is circular, the first portion being of a diameter dimensionally greater than the overall cross-section of each respective second portion and of the tool configuration.

9. A tool receiving device having at least one axially extending opening of polygonal cross-section with a plurality of longitudinally straight surfaces, the opening having an open end and a blind end, comprising in combination:

a tool member having a longitudinal portion with a polygonal cross-section conforming generally to that of the opening, an annular recess intermediate the ends of the portion and a tool configuration axially coextensive with at least one end of the portion; and an elastomeric ring arranged in the recess and having an outer diameter at least greater than the diameter of a circle tangent to the surfaces of the polygonal cross-section of the portion for frictionally engaging the respective straight surfaces of the opening when an end of the portion is inserted in the opening and abuts the blind end thereof to provide an optimum torque transfer between the device and the tool member.

* * * * *